United States Patent [19]

Chou et al.

[11] Patent Number: 4,986,095

[45] Date of Patent: Jan. 22, 1991

[54] RETRACTABLE LOCK STRUCTURE

[76] Inventors: Chao-Jen Chou; Teng-Yun Wang, both of P.O. Box 96-405, Taipei 10098, Taiwan

[21] Appl. No.: 573,380

[22] Filed: Aug. 27, 1990

[51] Int. Cl.[5] ..... E05B 73/00

[52] U.S. Cl. ..... 70/18; 70/46

[58] Field of Search ..... 70/14, 18, 20, 31, 35, 70/36, 37, 40, 41, 45, 46, 47, 48

[56] References Cited

U.S. PATENT DOCUMENTS

| | | | |
|---|---|---|---|
| 1,793,432 | 2/1931 | Sczepczenski | 70/46 |
| 2,963,895 | 12/1960 | Thomas | 70/18 |
| 3,747,376 | 7/1973 | White | 70/18 |
| 3,959,995 | 6/1976 | Fletcher | 70/18 |

*Primary Examiner*—Robert L. Wolfe

[57] ABSTRACT

It is a retractable lock, which mainly comprises a first pipe section with a lock cylinder at one end thereof, and with a spheric opening and a guide groove at the other end thereof, a connecting rod having a ball shaped part at one end thereof and a ball at the other end thereof so as to pivotally connect with a second pipe section having two spheric openings at both ends thereof respectively a locking rod having a ball end to coupled with one end of the second pipe section, and the other end thereof being coupled into the first pipe; when not use, all the parts of the lock can be retracted into the first pipe section for storage and carrying convenience.

1 Claim, 6 Drawing Sheets

RETRACTABLE LOCK STRUCTURE

BACKGROUND OF THE INVENTION

1. Field of the Invention

This invention relates to a lock, and particularly to a lock that comprises two hollow pipe sections, a connecting rod being pivotally connected with the two hollow pipe sections, and a locking rod being pivotally connected with the second pipe section. By means of the hollow spaces therein, the whole lock can be pulled out to set in locked-up condition or retracted into a straight piece for storage convenience.

2. Description of the Prior Art

In the conventional locks for motor-cycles, a lock usually comprises a U-shaped shackle and a lock body; both ends of the U-shaped shackle are inserted into two holes respectively on the lock body. In the holes of the lock body, there are locking-up assemblies respectively. After the U-shaped shackle is inserted into the holes on the lock body, the lock can be set in locked-up condition or in un-locked condition. So far, there are almost several decade kinds of U-shaped shackle locks for motor-cycles. Althrough they are different in their end structure of the U-shaped shackle locks, in their connection, and in their inner locking assemblies, they are common in the U-shaped shackle and in the locking cylinder to receive the U-shaped shackle.

The aforesaid conventional U-shaped shackle locks have a drawback, i.e., the U-shaped shackle takes a considerable space upon being put in a small trunk box or the like.

SUMMARY OF THE INVENTION

This invention provides a retractable lock structure, which mainly comprises a first and a second pipe sections, which are all hollow pipe sections. The ends of the pipe sections are, except one end of the first pipe section, provided with spheric openings respectively for mounting a corresponding number of ball-shaped parts therein; the first pipe section is designed to accomodate all the rest parts of the lock so as to change the whole lock into a straight piece for storage convenience when not in use.

According to the present invention, one end of the first pipe section is mounted with a lock cylinder, of which the outer edge of a locking ring has a round hole to facilitate the locking rod to engage therein for locking up. The other end of the first pipe section has a guide slot for mounting the ball-shaped part of the connecting rod; the other end of the connecting rod is also formed into a ball-shaped part to be movably connected with one end of the second pipe section; the other end of the second pipe section has a spheric opening for receiving the ball-shaped part of the locking rod; therefore, most parts of the lock can be retracted into the second and first pipe section in a nest manner to become a straight piece for storage convenience.

According to the present invention, the ends of the first and second pipe sections are provided with a corresponding number of spheric openings respectively for movably receiving the ball-shaped parts on the ends of the connecting rod to furnish a positioning and stap function. Beside each of the spheric openings there is a guide slot to provide a one-way guide function to the connection rod. Each of the ball-shaped parts has a positioning stud. On the opposite side of each guide slot, there is a positioning hole for fixing the connecting rod in place upon the ball-shaped part being set in place.

The first pipe section according to the present invention is a hollow pipe, in which the ball-shaped part of the connecting rod and the second pipe section can be inserted therein; also, the other end of the connecting rod can be inserted into the second pipe section. The locking rod can also be inserted in the second pipe section to form into a single straight piece for storage convenience.

According to the present invention, both the first and second pipe section are furnished with spheric openings and guide slots respectively so as to provide a 90 degrees angle connection during the lock set in locked-up condition, and to have the first and second pipe sections set in parallel position; simultaneously, the connecting rod and the locking rod are also set in parallel position. Between each rod and pipe section, there is a positioning and a guide parts so as to have all the parts assembled set in a fixed and steady manner without any swinging or twisting upon the lock being set in locked-up position.

According to the present invention, the locking rod has positioning channel between the ball-shaped part and the locking rod; the positioning channel is located at one side of the locking rod so as to guide and control the round lock groove to be engaged with the locking ring for quickly guiding into a locked-up condition.

According to the present invention, one end of the first pipe section is mounted with a cap, which is to be attached to the lock cylinder at one end of the first pipe section during the lock set in locked-up condition, or to be attached to the other end of the first pipe section during the lock set in retracted condition for storage to prevent the parts therein from dropping out un-intentionally.

According to the present invention, the lock can be retracted together into a single straight piece for storage convenience without taking much space. When the lock is set in locked-up condition, the various parts of the lock are connected and set in a fixed position by means of the guide and positioning means designed.

DETAILED DESCRIPTION OF THE PREFERRED EMBODIMENT

Figure 1:
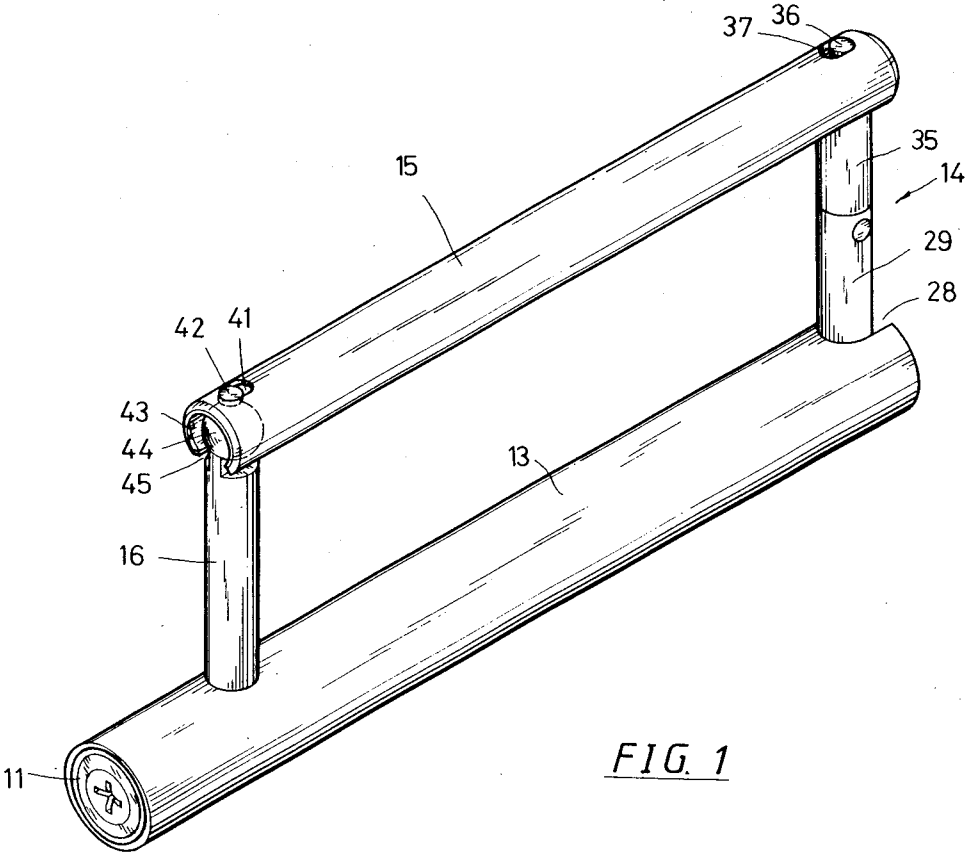
FIG. 1 is a perspective view of an embodiment according to the present invention.
Figure 2:
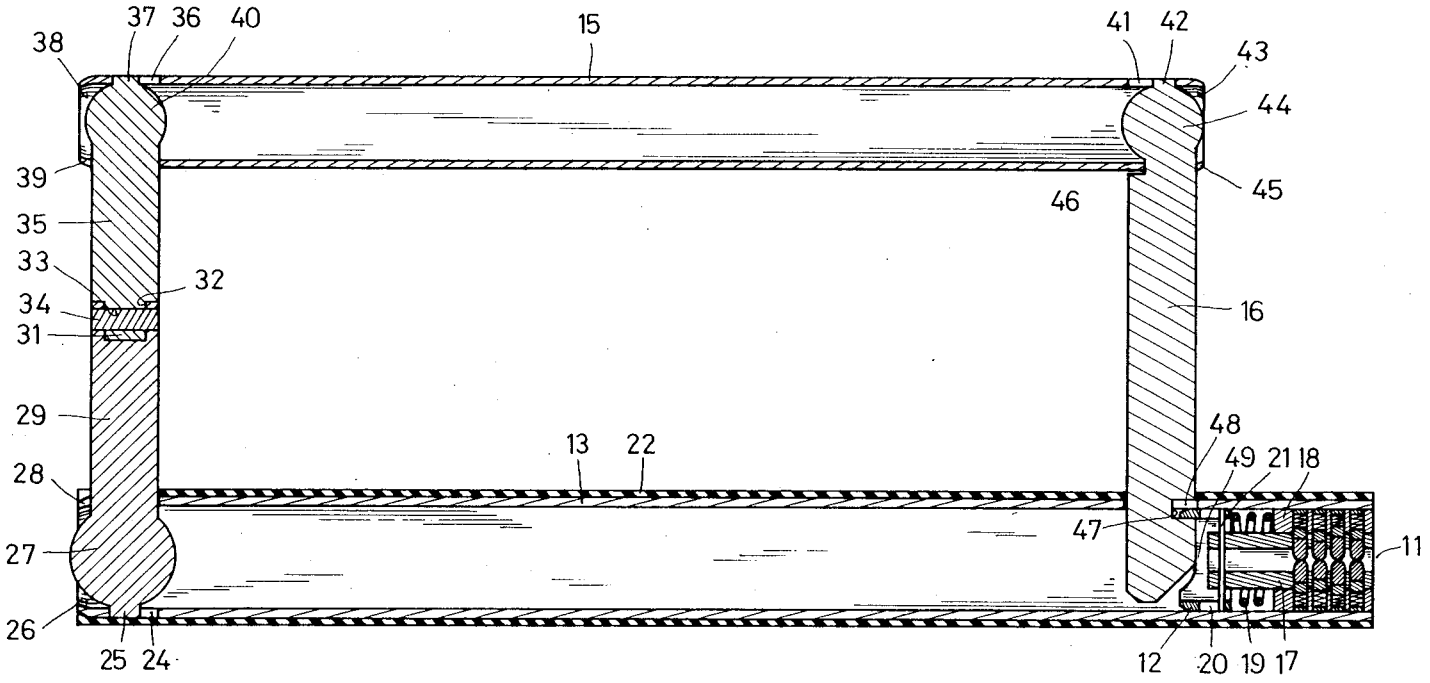
FIG. 2 is a sectional view of the present invention, showing a locked-up position.
Figure 3:
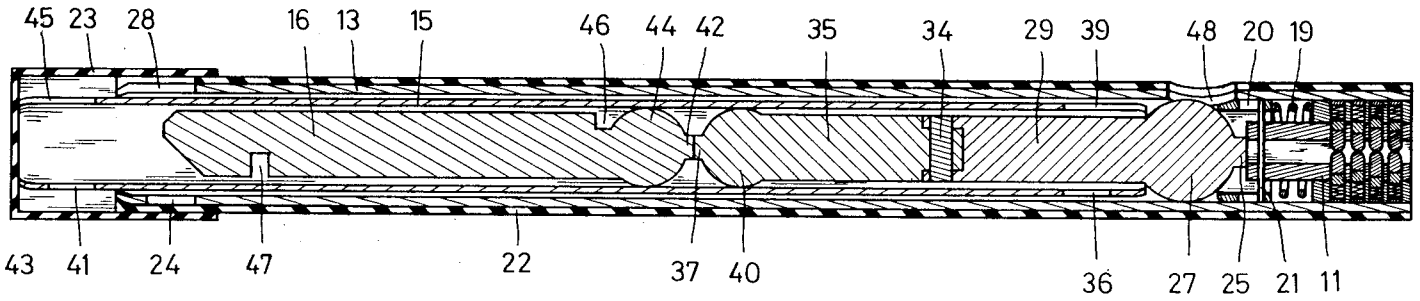
FIG. 3 is a sectional view of the present invention, showing an unlocked position.
Figure 5:
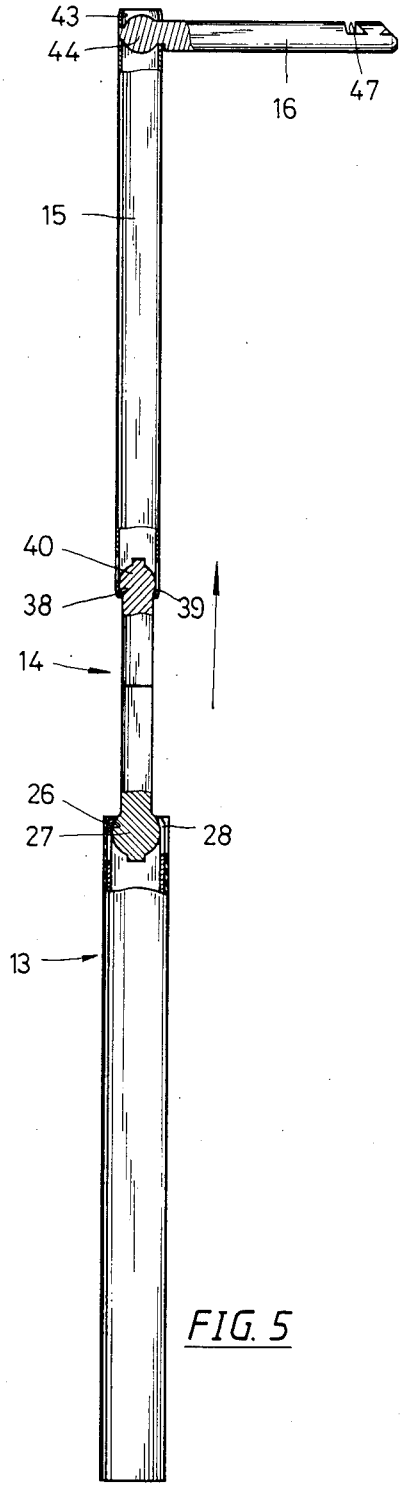
FIG. 5 illustrates the second operation step of the present invention being pulled out of the casing thereof.

Referring to FIGS. 1 to 3, the present invention is a retractable lock structure, which mainly comprises a lock cylinder 11, a locking ring 12, a first pipe section 13, a connecting rod 14, a second pipe section 15, and a locking rod 16. Both the first pipe section 13 and the second 15 are hollow pipes. The ends of the connecting rod 14 and the locking rod 16 are provided with balls respectively. The ends of the first pipe section 13 and the second pipe section 15 are furnished with spheric portions respectively so as to be connected with the connecting rod 14 and the locking rod 16; both spheric partions have guide grooves respectively to facilitate the connection and guide with other related parts.

When the lock structure is set in locked-up condition, one end of the locking rod 16 is inserted into a round hole 48 in the first pipe section 13. A lock cylinder 11 and a locking ring 12 are installed in one end of the first pipe section 13 for actual locking function. When the lock is in storage condition, the whole lock is recovered and retracted into a straight piece.

Figure 8:
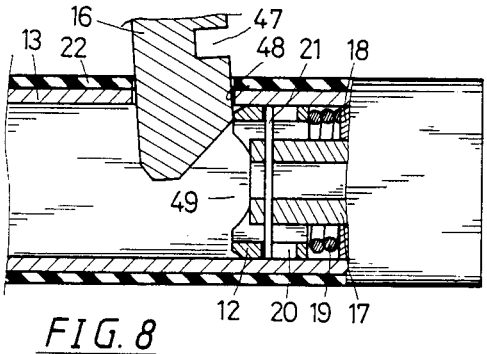
FIG. 8 is a fragmental sectional view of the present invention, showing the locking ring being pushed to move.
Figure 9:
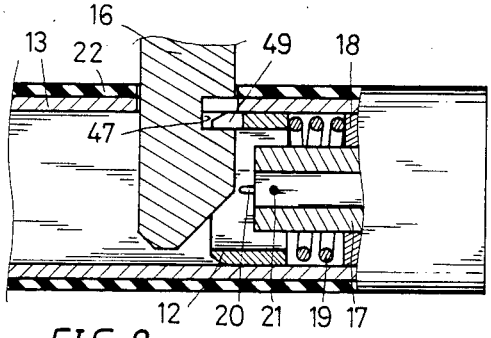
FIG. 9 is a fragmental sectional view of the present invention, showing the locking ring being rotated at an angle of 90° to unlock the lock.

The major parts of the present invention are further described as follows:

One end of the first pipe section 13 is mounted with a lock cylinder 11, which is fixed in place with a pin. After an outer lock cylinder 18 is fixedly installed in the lock cylinder 11, the internal end of an inner lock cylinder 17 is mounted with a pin 21 and a locking ring 12 through a round hole. A spring is installed between the lock cylinder 11 and the locking ring 12 so as to maintain the locking ring 12 in a tension condition to facilitate the locking rod 16 to insert therein. The locking ring 12 has an un-locking cut 49 being opposite to a round hole 48 on the first pipe section 13; that arrangement can facilitate the locking rod 16 to pull out upon the locking cylinder 11 being un-locked. The locking ring 12 has a round flange, whereby the locking ring 12 can be pushed in easily upon the locking rod 16 being pushed into the round hole 48, please referring to FIGS. 8 and 9. The locking ring 12 is pushed inwards by the locking rod 16 until the edge of the locking ring 12 being retained in a round lock groove 47. There is a guide groove 20 being furnished between the locking ring 12 and the pin 21, whereby the locking ring 12 can be moved back and forth as a result of the spring 19; therefore, the lock can be set in locked-up position automatically upon the locking rod 16 being inserted into the round hole. Since the locking ring 12 is mounted, with a pin 21, on the inner lock cylinder 17, it can be rotated together with the inner lock cylinder 17 upon the lock being un-locked, as shown in FIG. 9.

The other end of the first pipe section 13 is pivotally connected with the connecting rod 14, of which one end of the stem part 29 has a ball shaped part 27 with a positioning stud 25 to be mounted in the first pipe section 13. The end of the first pipe section 13 has a spheric opening 26, which is used for preventing the ball-shaped part 27 of stem part 29 from being pulled out of the spheric opening 26 so as to let the ball-shaped part 27 to rotate freely in the spheric opening. Beside the spheric opening 26, there is a guide slot 28, whereby the connecting rod 14 can be moved at an angle of 90°. On the opposite side of guide slot 28, there is a positioning hole 24 to facilitate the positioning stud 25 to be guided into the positioning hole 24 upon the stem part 29 rotating at an angle of 90° for positioning .

The stem part 29 is positioned right behind the spheric opening 26 of the first pipe section 13. The other end of the stem part 29 with a stem part 35 having the same structure as the stem part 29. The two stem parts 29 and 35 are connected together by means of connecting hole 32 on the stem part 29 and a round stud 31 on the stem part 35. One side of the round stud 31 has a connecting hole 33; a pin 34 is inserted through the two connecting holes 32 and 33 so as to fixedly connect the two stem parts into one piece.

The connecting rod 14 includes two stem parts 29 and 35; one end of the stem part 35 is formed into a ball-shaped part 40 with positioning stud 37 to be mounted into the second pipe section 15, of which one end has a spheric opening 38 for mounting and retaining the ball-shaped part 40 therein; the edge of the spheric opening 38 has a guide groove 39 to facilitate the stem part 35 to move at an angle of 90°. On the opposite side of the guide groove 39, there is positioning hole 36 to facilitate the stem part 35 to move at an angle of 90° and to facilitate the positioning stud 37 to move therein so as to guide the connecting rod 14 to move in an accurate angle. The ball-shaped parts 27 and 40 are set at an angle of 90° with the first and second pipe sections 13 and 15 respectively.

One end of the second pipe section 15 is movably connected with the stem part 35, while the other end thereof is pivotally connected with the locking rod 16, of which one end is formed into a ball-shaped part 44 with a positioning stud 42. Between the locking rod 16 and the ball-shaped part 44, there is a positioning channel 46. The locking rod 16 is mounted in the hollow case of the second pipe section 15, of which one end has a spheric opening 43 and a guide slot 45. The spheric opening 43 is used for movably mounting the ball-shaped part 44 of the locking rod 16; the guide slot 45 is used for guiding the locking rod 16. A positioning hole 41 is furnished on the opposite side of the guide slot 45. Both the guide slot 45 and the positioning hole 41 are used for facilitating the locking rod 16 to move at an angle of 90° and to fix in place. The positioning channel 46 in the locking rod 16 is used for setting the locking rod 16 and the second pipe section 15 at an angle of 90° and for preventing the locking rod 16 from rotating; further, the positioning channel 46 is also used for controlling the round lock groove 47 to face the locking ring 12 upon the locking rod 16 being inserted into the round hole 48 of the first pipe section 13; at the same time, the locking ring 12 is pushed to move, and there is moved to a locked-up position between the round lock groove 47 and the locking ring 12.

Figure 4:
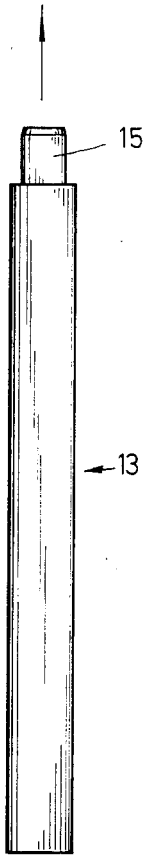
FIG. 4 illustrates the first operation step of the present invention being in a position to be pulled out.
Figure 6:
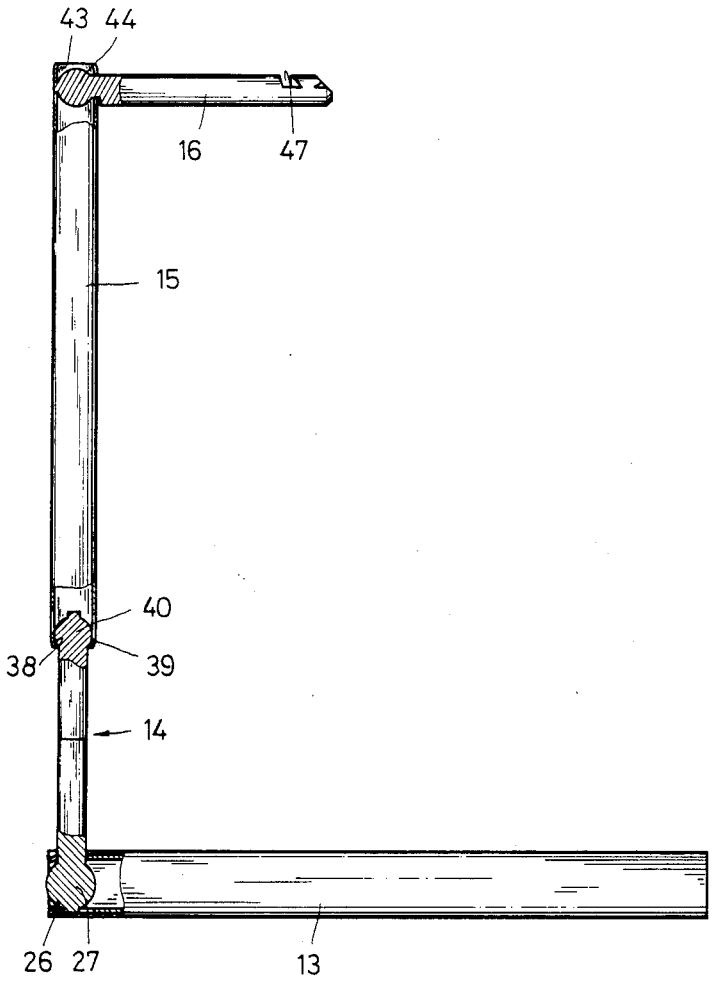
FIG. 6 illustrates the third operation step of the present invention being pulled out and changing the direction of one part thereof.
Figure 7:
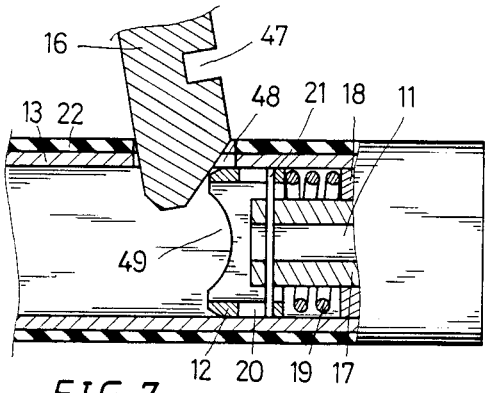
FIG. 7 is a fragmental sectional view of the present invention, showing the end of the locking rod entering the round hole of the first pipe section.

As shown in FIGS. 3 and 4, the lock structure according to the present invention, when not in use, can be disassembled and recovered into a straight piece by putting the locking rod 16 and the connecting rod 14 in the hollow casing of the second pipe section 15, which is then inserted into the first pipe section 13. One end of the first pipe section 13 is covered with a cap 23 to preventt the connecting rod 14, the second pipe section 15 or the locking rod 16 from sliding out of the first pipe section 13.

When the lock is set in locked-up condition as shown in FIGS. 2 and 4 to 6, the cap 23 at one end of the first pipe section 13 is removed first, and then pull out in turn, the locking rod 16, the second pipe section 15, and the connecting rod 14 (or pouring out directly). Since the pipe section has a spheric openings, and the stem part has a ball-shaped part, the pivotally connected ends can be turned in any direction. After the positioning channel 46 of the locking rod 16, and the guide slot 45 of the second pipe section 15 are set in correct direction, the locking rod 16 can directly be moved to the round hole 48 of the first pipe section 13; simultaneously, the ball-shaped parts on both ends of the connecting rod 14 will automatically be connected with the guide groove 39 of the locking rod to form a right angle (90°) connection, i.e., a fixedly assembled position.

Briefly, the lock according to the present invention mainly comprises a first pipe section 13, a connecting rod 14, a second pipe section 15 and a locking rod 16, which can pivotally be connected together by means of a ball-shaped part, a spheric opening and a guide groove; the various pipe sections and rods can easily be pulled out upon the locking rod 16 and the second pipe section 15 being guided to a correct direction; then, the round hole 48 on the first pipe section 13 can be engaged with the locking rod 16, and lock cylinder 11 can be engaged with the locking ring 12. The lock according to the present invention, when not in use, can be recovered and retracted into straight piece, and therefore the present invention is deemed a novel and practical disclosure.

We claim:

1. A new retractable lock structure mainly comprising:

a first pipe section, of which one end is mounted with a lock cylinder; and said lock cylinder being connected together in a flexible manner; and the other end of said first pipe section having a spheric opening of which one side having guide slot; a positioning hole being provided on the opposite side of said guide slot; and said first pipe section being pivotally connected with one end of a connecting rod;

a connecting rod including two stem parts, of which both ends have two ball-shaped parts with positioning studs respectively; and said ends being mounted in spheric openings on the ends of said first pipe section and a second pipe section;

a second pipe section being a hollow pipe, of which both ends have two spheric openings and two guide slots respectively; and a positioning hole being provided at the opposite side guide slot; and one end of said second pipe section being connected with one end of said connecting rod, while the other end being connected with one end of a locking rod;

a locking rod having a ball-shaped part with a positioning stud on one end thereof; and a positioning channel being furnished between said ball-shaped part and said locking rod; and the other end of said locking rod being formed into a slanting point with a round lock groove; and said first and second pipe sections being hollow pipes, and said first pipe section being used as a casing to accommodate said connecting rod and said second pipe section; and said second pipe section being used as a casing to accommodate said connecting rod and said locking rod upon the locking being recovered and put in storage condition; and the ends of said second and first pipe sections being provided with spheric openings respectively so as to facilitate said ball-shaped parts on said connecting rod and said locking rod to connect and engage thereto respectively.

* * * * *